US006895951B2

(12) United States Patent
Summers et al.

(10) Patent No.: US 6,895,951 B2
(45) Date of Patent: May 24, 2005

(54) ADJUSTABLE BACK TENSION ROPE RELEASE

(75) Inventors: Gregory E. Summers, P.O. Box 498, Madison Heights, VA (US) 24572; Marc T. Rentz, Madison Heights, VA (US); Randy V. Summers, Madison Heights, VA (US)

(73) Assignee: Gregory E. Summers, Forest, VA (US)

( * ) Notice: Subject to any disclaimer, the term of this patent is extended or adjusted under 35 U.S.C. 154(b) by 0 days.

(21) Appl. No.: 10/671,603

(22) Filed: Sep. 29, 2003

(65) Prior Publication Data

US 2004/0079351 A1 Apr. 29, 2004

Related U.S. Application Data

(63) Continuation-in-part of application No. 10/173,747, filed on Jun. 19, 2002, now Pat. No. 6,647,976, which is a continuation-in-part of application No. 09/925,023, filed on Aug. 9, 2001, now Pat. No. 6,584,966.

(51) Int. Cl.[7] ..... F41B 5/18
(52) U.S. Cl. ..... 124/35.2
(58) Field of Search ..... 124/35.2

(56) References Cited

U.S. PATENT DOCUMENTS

| | | | | |
|---|---|---|---|---|
| 3,845,752 A | | 11/1974 | Barner | |
| 3,849,912 A | * | 11/1974 | Kemnitzer | 434/98 |
| 3,853,111 A | * | 12/1974 | Stanislawski et al. | 124/35.2 |
| 3,965,884 A | * | 6/1976 | Killian | 124/35.2 |
| 4,877,009 A | * | 10/1989 | Becker | 124/35.2 |
| 5,692,490 A | | 12/1997 | Walker | |
| 5,694,915 A | * | 12/1997 | Summers | 124/35.2 |
| 6,571,786 B2 | | 6/2003 | Summers et al. | |
| 6,584,966 B1 | | 7/2003 | Summers et al. | |
| 6,631,709 B2 | | 10/2003 | Carter et al. | |
| 6,647,976 B2 | | 11/2003 | Summers et al. | |
| 2003/0154969 A1 | | 8/2003 | Carter | |
| 2003/0159682 A1 | | 8/2003 | Pellerite | |

OTHER PUBLICATIONS

"The Comfort Release" from Zenith Archery Products.*
Carter Release Aids from www.carterenterprises.com.*
Stanislawski Archery Products, New Releases for 1997.*
Stanislawski Archery Products brochure, 1974 Deser Inn Classic.*
Bernie's Can't Punch "Back Tension" Wrist Strap Release advertisement, 1998.*
www.copperjohn.com, "Original Stan Micro Instructions" dated Jun. 27, 2003, and "Product Details—Original STAN micro—Two Finger—Red.".
Carter Enterprises, "Solution 2.5 (3–Finger) General Directions for Use," undated.
Carter Enterprises, "Solutions 3 General Directions for Use," undated.
www.bowhuntingzone.com, "Sweet Spots are Here!!!—Archer's Retreat & Archery Network Message Boards," TRUBALL posting of Nov. 15, 2001, 04:13 PM.
T.R.U. Ball Release, "Sweet–Spot—Everything Else is Obsolete!, " Aug. 2001.

* cited by examiner

*Primary Examiner*—John A. Ricci
(74) *Attorney, Agent, or Firm*—Nixon & Vanderhye P.C.

(57) ABSTRACT

A triggerless back tension release for use with a bow string comprising a handle; a release head assembly including a rope loop and a first component pivotally mounted relative to a portion of the handle, the first component carrying a sear element having a sear edge and a hook adapted for receiving the rope loop; a locking rod located in the handle portion and actuated by a lever in the handle portion to engage and lock a second component of the release head assembly relative to the handle portion, the second component arranged to interact with the sear edge and to release the sear element and thereby release the bow string upon movement of the handle portion.

23 Claims, 22 Drawing Sheets

ADJUSTABLE BACK TENSION ROPE RELEASE

This is a continuation-in-part of application Ser. No. 10/173,747 filed Jun. 19, 2002, now U.S. Pat. No. 6,647,976 continuation-in-part of application Ser. No. 09/925,023 filed Aug. 9, 2001, now U.S. Pat. No. 6,584,966, the entire contents of which are incorporated herein by reference. This invention relates to a bow string release and, more specifically, to a triggerless back-tension type release.

BACKGROUND OF THE INVENTION

Various release devices are utilized in archery to assist the archer in pulling a bow string to a fully drawn position and then releasing the bow string to fire, an arrow. Many of these devices include mechanical grippers that engage the bow string directly, or that engage nock elements mounted on the bow string. Other devices use rope looped about the bow string as the release mechanism with or without a mechanical trigger. In release devices of the latter kind, the looped rope is often subject to a twisting action as the archer draws the bow string due to a cocking or turning action of the archer's wrist. This kind of twist or torque applied to the release rope can result in reduced arrow speed and accuracy.

Conventional triggerless back tension rope releases are disclosed in U.S. Pat. Nos. 5,694,915 and 5,965,884. In release aids of this type, it is simply a slight movement of the archer's arm and/or hand, after the arrow is fully drawn, that causes release of the rope loop from the rope loop hook on the sear, and the concurrent release of the bow string.

It also is known to provide a sensitivity adjustment feature that permits adjustment of a "pawl" member that engages and interacts with the sear to thereby change the degree of movement of the archer's hand required to release the arrow. Increased sensitivity, however, increases the potential for accidental premature firing and/or the possibility of injury to the archer as is or her arm snaps back toward the face.

BRIEF SUMMARY OF THE INVENTION

This invention relates to a triggerless back tension rope release that provides additional freedom of movement during draw by incorporating, in one exemplary embodiment, a two-link release head assembly, each link (a forward link and an intermediate link) freely pivotable about respective pivots relative to each other and to the release handle. The sear, formed with a rope loop hook, is pivotably mounted on the forward link while a D-shaped pawl is adjustably fixed for movement with the intermediate link. This arrangement allows the archer to draw the bow, with the handle portion of the release assuming various positions and angles throughout the draw cycle, relative to the release head assembly but without affecting the relationship between the pawl and the sear. A locking mechanism is provided that includes mutually perpendicular drive and locking rods that can be actuated through a lever in the handle portion to lock the intermediate link of the release head in any desired position, but leaving the forward link that supports the sear free to swivel relative to its respective pivot axis, with its arcuate range limited by the position of the intermediate link. In this locked position, the handle, intermediate link and pawl will move together relative to the sear. The arrow can then be released by the conventional movement or flexing of the hand and/or wrist that causes the pawl to move to a position that releases the sear for movement, i.e., the sear edge moves over the pawl edge, that concurrently causes the rope loop to disengage from the sear hook and the arrow to fire, under the influence of tension in the bow string.

In another arrangement, the "pawl" has a substantially triangular shape with radiused corners where the sides of the triangle meet the base. In this case, the sear edge is arranged to engage one of the sides of the triangle adjacent the base, and to be released as it passes across one of the radiused corners when the archer moves the release and the pawl sufficiently to allow the rear edge to clear the pawl. A pair of set screws are arranged to engage the two sides of the triangle, thus permitting very fine adjustments to the pawl vis-a-vis the sear. Since the pawl is pivotally mounted through a center portion thereof, the set screws engaging the side of the triangle work in opposed directions, i.e., tightening of one requires loosening of the other and vice versa.

The above described release head assembly and locking mechanism allows the archer to find the optimum draw position before locking the intermediate link, eliminating or at least significantly reducing any potential premature firing of the arrow.

It is another feature of the invention to fix the rope loop ends at a location on the forward link of the release head assembly that is closely adjacent and forward of the pivot pin of the sear, and more particularly, closely adjacent the rope loop hook on the sear. This arrangement insures that the release rope travels from its connection holes in the forward link in a straight line around the bow string and back to the sear hook, where the distance between the release rope lengths at the bow string is equal to or greater than the distance between the release rope lengths at the rope connection holes in the sear and the rope loop hook on the sear. In other words, the distance between the rope release lengths at the sear is substantially equal to or less than the diameter of the bow string. This insures that the bow string is maintained accurately in the exact same position of the release rope "cradle," not allowing the bow string to slide or move to a varying positions, thereby maintaining a consistent amount of back tension travel to release the shot.

In another and presently preferred embodiment, the release head assembly is simplified to include a link or yoke pivotally mounted at one end thereof via a pin on the handle portion of the release. The sear and integral rope hook is pivotally mounted to the other end of the yoke, while the pawl or pawl head component has been redesigned to include certain structural features of the intermediate link of the first described embodiment. The pawl component is located between laterally spaced ears of the yoke and is pivotally mounted via the same pin that mounts the yoke to the handle portion. The locking mechanism remains unchanged, but the locking rod engages and locks the pawl element directly. Otherwise, the functionality of the release remains essentially as described above.

Thus, in accordance with one aspect, the invention relates to a triggerless back tension release for use with a bow string comprising a handle; a release head assembly including a rope loop and a first component pivotally mounted relative to a portion of the handle, the first component carrying a sear element having a sear edge and a hook adapted for receiving the rope loop; a locking rod located in the handle portion and actuated by a lever in the handle portion to engage and lock a second component of the release head assembly relative to the handle, the second component arranged to interact with the sear edge and to release the sear element and thereby release the bow string upon movement of the handle.

In accordance with another aspect, the invention relates to a triggerless back tension release for use with a bow string comprising a handle; a release head assembly including a rope loop and a first component pivotally mounted relative to a portion of the handle, the first component comprising a yoke having a pair of laterally spaced sides and ears depending from the sides, and a first pin extending through the ears and the portion of the handle to thereby pivotally mount the yoke to the portion of the handle; a sear element located between the laterally spaced sides and pivotally mounted to the yoke by a second pin extending through the sides and the sear element, the sear element having a sear edge and a hook adapted for receiving the rope loop; a pawl head located between the laterally spaced ears and carried by the first pin, the pawl head having a pawl edge arranged to interact with the sear edge and thereby free the sear element for rotation permitting the rope loop to escape the rope hook; and a locking rod located in the handle and actuated by a lever in the handle, the locking rod adapted to engage and lock the pawl head relative to the handle.

BRIEF DESCRIPTION OF THE DRAWINGS

FIG. 12 is an end elevation of the locking rod shown in. FIG. 11;

DETAILED DESCRIPTION OF THE INVENTION

Figure 1:
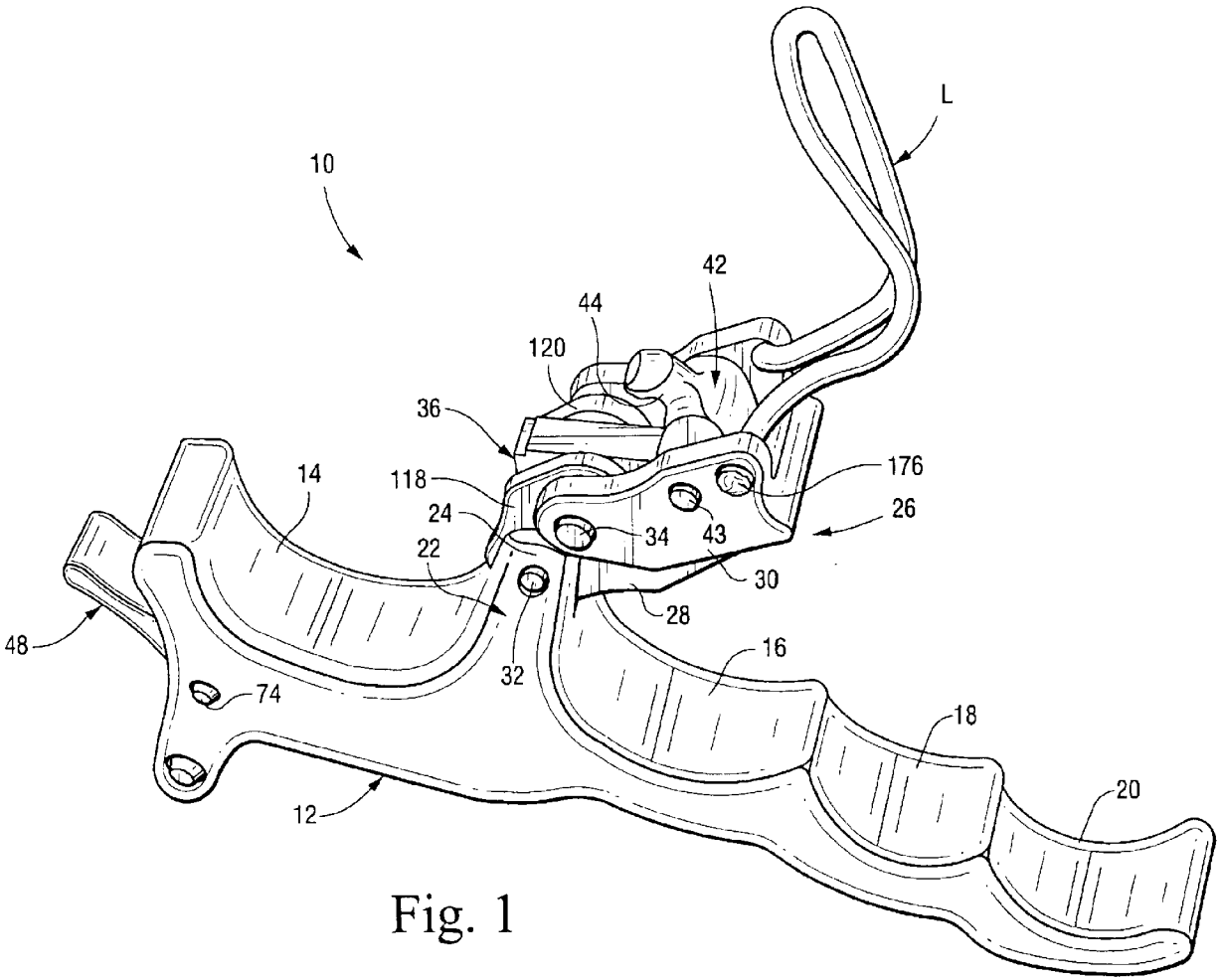
FIG. 1 is a perspective view of the release in accordance with an exemplary embodiment of the invention.

With reference initially to FIGS. 1-4, the release 10 generally includes a handle portion 12 formed with finger grooves 14, 16, 18 and 20 for four-fingered engagement. The number of grooves may be varied as desired, however, depending on personal preference. For example, the release could also have two or three finger grooves. A post 22 extends generally perpendicularly away from the handle portion 12, between the first and second finger grooves 14 and 16, terminating at a fork including a pair of substantially identical laterally spaced bosses 23, 24.

Figure 23:
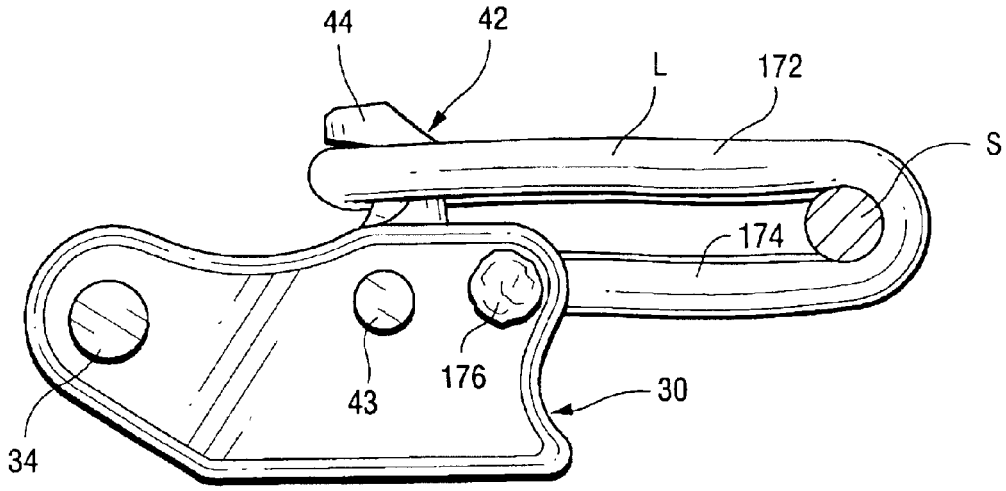
FIG. 23 is a side elevation of the forward link and sear components, with a rope loop wrapped about a bow string and secured to a rope loop hook on the sear.
Figure 24:
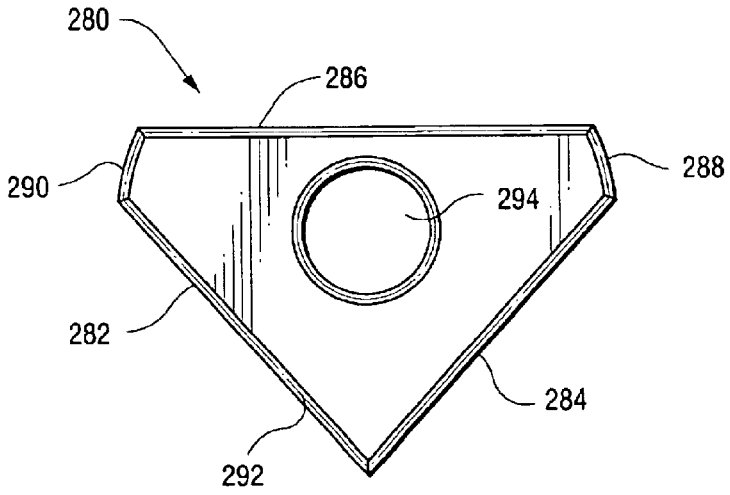
FIG. 24 is a side elevation of a modified pawl element in accordance with a second embodiment of the invention.
Figure 25:
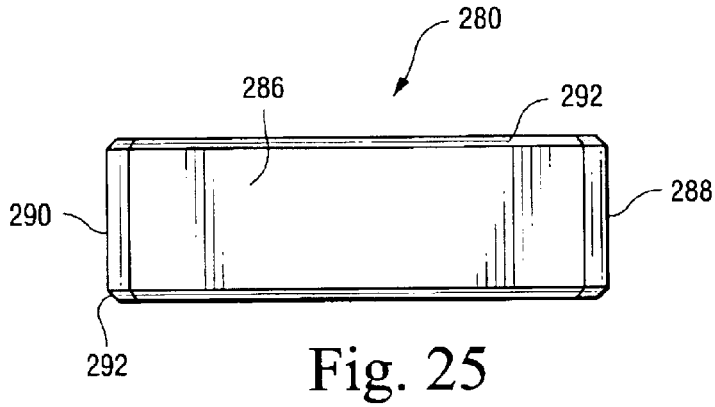
FIG. 25 is a plan view of the pawl shown in FIG. 24.
Figure 26:
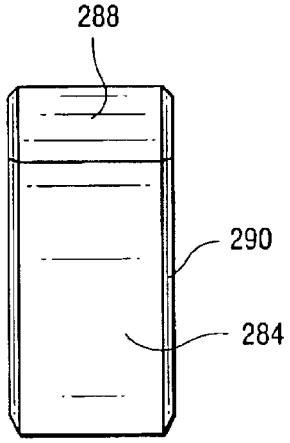
FIG. 26 is a right side view of the pawl shown in FIG. 24.

A release head assembly 26 includes intermediate and forward release links 28 and 30, respectively. The intermediate link 28 is pivotally mounted to the post 22 via pin 32, while the forward release link 30 is pivotally mounted to the intermediate release link 28 via pin 34. A pawl 36 (FIGS. 1, 3, 16 and 17) in the form of a truncated or generally D-shaped disk, is adjustably fixed to the intermediate link 28, also via pin 34 and a set screw 38 (FIG. 3) threadably received in a bore 40 in the intermediate link. A sear 42 is pivotally secured to the forward release link 30 via pin 43. The sear 42 has a forward rope loop hook 44 for receiving a rope loop L, and a rearward edge 46 (FIGS. 3 and 4) that cooperates with the pawl 36 as explained further below. It will be appreciated that the loop L is adapted to be wrapped about a bow string S, with the end of the loop L slipped over the hook 44, as illustrated in FIG. 23.

Handle portion 12 supports a locking lever 48 adjacent the index finger groove 14 that is adapted for engagement by the user's thumb. The lever 48 is operatively connected to the intermediate release link 28 via cooperating drive and locking rods as described below. A more detailed description of all of the various component parts of the release follows.

Figure 3:
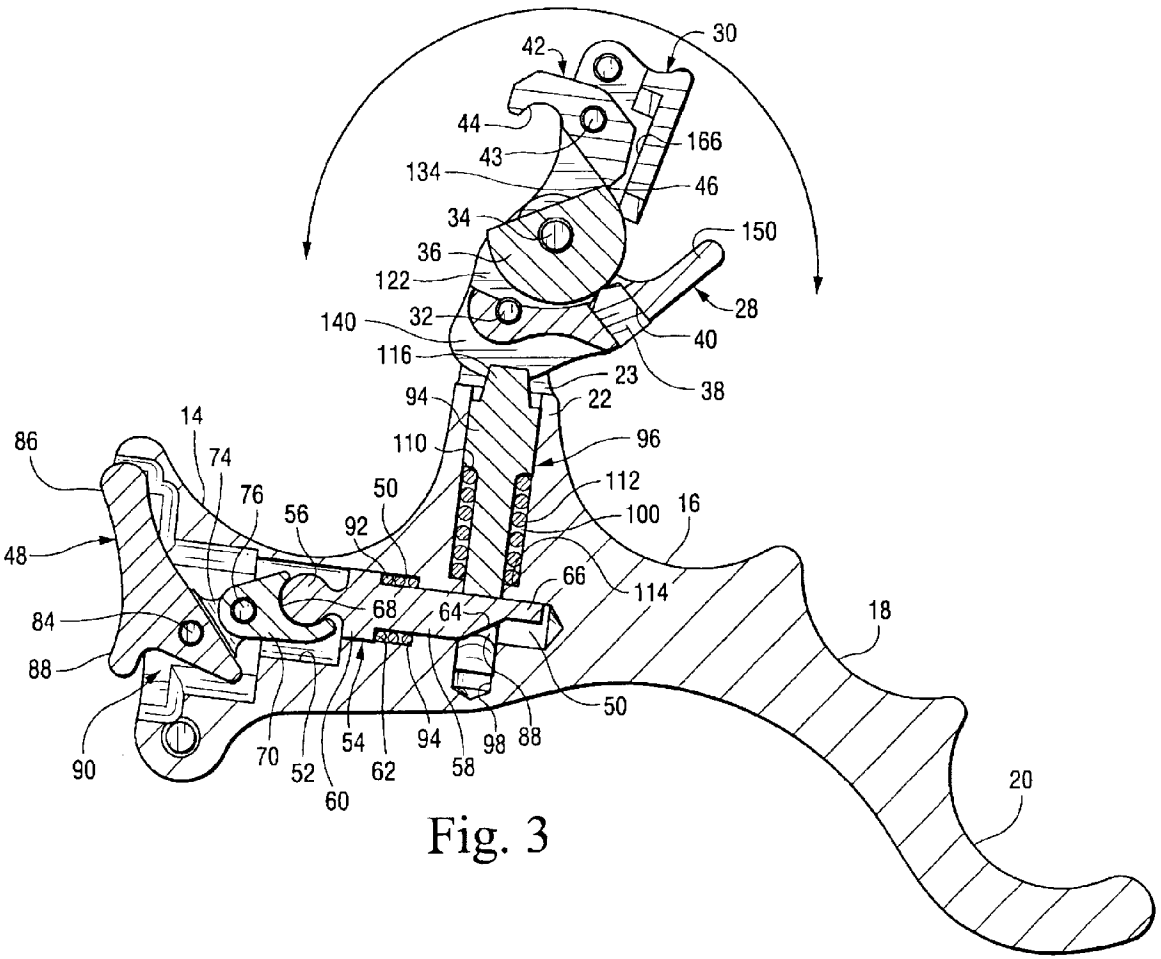
FIG. 3 is a cross section through the release shown in FIGS. 1 and 2, but with intermediate and forward links of the release head assembly rotated relative to one another, and with a locking mechanism in an unlocked position.
Figure 4:
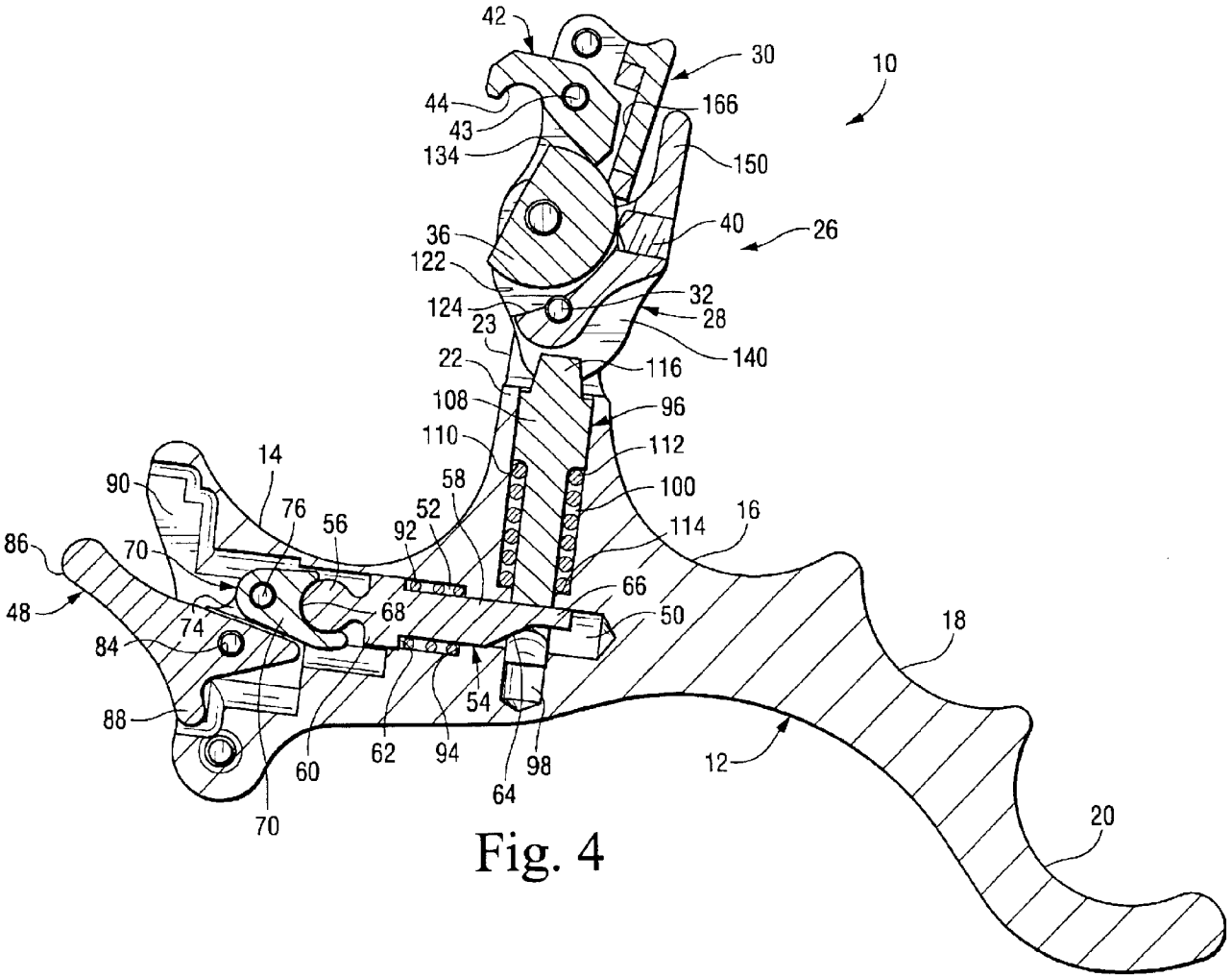
FIG. 4 is a cross section similar to FIG. 3 but illustrating the forward and intermediate links of the release head assembly with the intermediate link rotated relative to the forward link of the release head assembly, and with the locking mechanism in a locked position.
Figure 8:
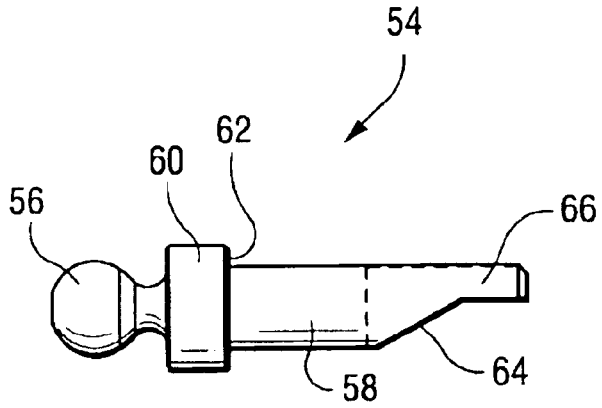
FIG. 8 is a side elevation of a drive rod incorporated into the release shown in FIGS. 1-4.
Figure 9:
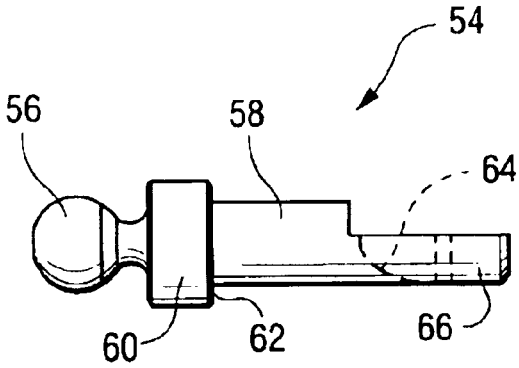
FIG. 9 is a top plan view of the drive rod shown in FIG. 8.
Figure 10:
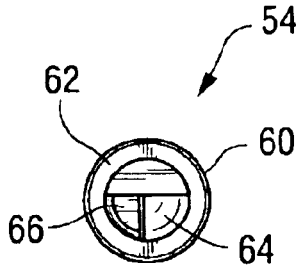
FIG. 10 is a right end elevation of the drive rod shown in FIG. 9.
Figure 11:
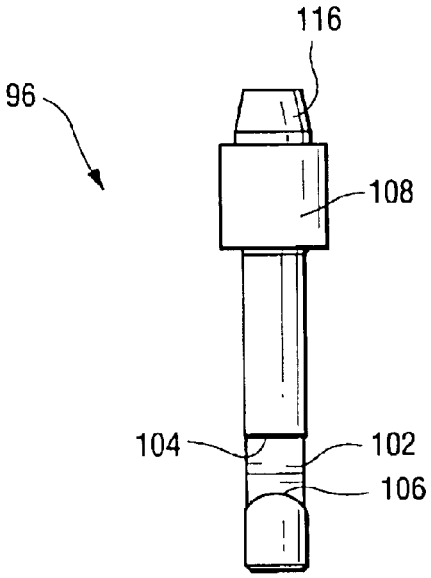
FIG. 11 is a side elevation of a locking rod incorporated into the release shown in FIGS. 1-4.
Figure 12:
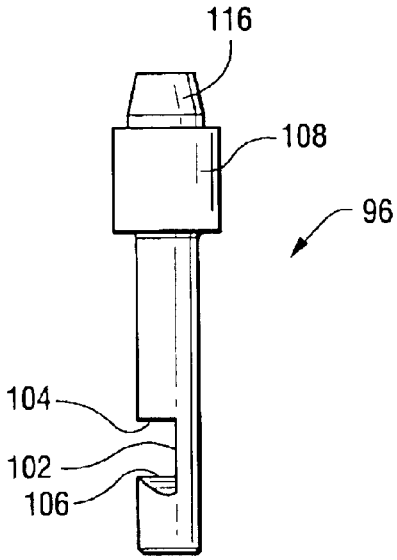

As best seen in FIGS. 3 and 4, the handle portion 12 (preferably made of aluminum) is machined to provide a blind bore 50, counterbored at 52, and is adapted to receive a drive rod 54. With reference also to FIGS. 8-10, the latter is generally cylindrical in shape, with a spherical or ball-shaped rearward end 56 and a main body portion 58, with an enlarged diameter portion 60 having a forward radial shoulder 62 located between the end 56 and main body portion 58. Adjacent the forward end of the main body portion, a tapered cam surface 64 is formed in a circumferential portion of the drive rod, merging with a forward tip 66. Note that the cam surface 64 and forward tip 66 occupy just over 50% of the cross sectional area of the drive rod main body portion 58 as apparent from FIGS. 8-10.

Figure 5:
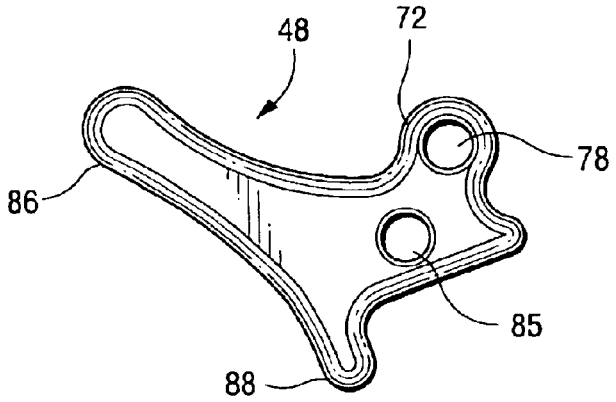
FIG. 5 is a side elevation of a locking lever incorporated into the release shown in FIGS. 1-4.
Figure 6:
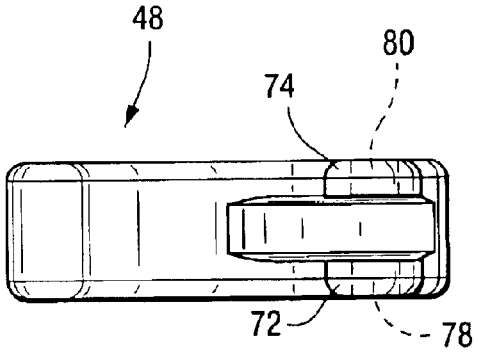
FIG. 6 is a top plan view of the lever illustrated in FIG. 5.
Figure 7:
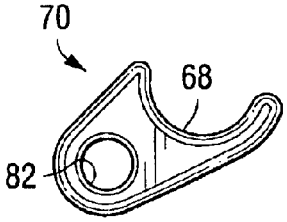
FIG. 7 is a side elevation of a toggle link incorporated into the release shown in FIGS. 1-4.

Referring to FIGS. 3 and 4 but with additional reference to FIGS. 5-7, the spherical or ball-shaped rearward end 56 of the drive rod 54 is received within a cradle portion 68 of a toggle link 70. The latter is pivotally secured between a pair of raised bosses 72, 74 on the lever 48 via pin 76 that is press fit within aligned holes 78, 80 in the bosses 72, 74 of lever 48, passing through aligned hole 82 in the link 70. It will be appreciated that the toggle link 70 is pivotable about the pin 76. The lever 48 is, in turn, secured to the handle portion 12 via pin 84 that passes through hole 85 in lever 48 such that the lever is pivotable about the pin. The lever 48 is formed with a pair of opposite user engageable ends 86, 88 and is adapted to seat in an asymmetrically shaped recess 90 machined into the end of the handle portion, recess 90 opening to the counterbore 52. A coil spring 92 located between shoulder 94 of counterbore 52 and the forward shoulder 62 of the drive rod 54 to bias the drive rod to the left (as viewed in FIGS. 3 and 4).

In the position shown in FIG. 4, the lever 48 has been pressed at 88 to cause the lever to pivot in a counterclockwise direction about the pin 84, causing the toggle link 70 and drive rod 54 to be drawn to the left as viewed in FIGS. 3 and 4 by the lever 48, with drive rod 54 following under the influence of spring 92. Note in this position that pin 76 is substantially centered on the longitudinal axis of the drive rod 54.

A locking rod 96 is slidably mounted in a bore 98, counterbored at 100 and extending primarily within the post 22, but perpendicularly intersecting the bore 50. The locking rod 96 is formed near its lower end (as viewed in FIGS. 3, 4, 11 and 12), with a cut-out portion 102 to one side of the rod, as defined by an upper flat surface 104 and a lower radiused cam surface 106. The surface 106 is engageable by tapered cam surface 64 of the drive rod 54.

The locking rod 96 is also formed with an enlarged diameter portion 108 (as defined in part by shoulder 110) that slides in the counterbore 100. A coil spring 112 is located between shoulder 110 and shoulder 114 of the counterbore 100, thus biasing the locking rod 96 in a direction toward the release head assembly 26. The forward end of the locking rod is formed as a solid truncated cone 116 that serves as the locking surface as described further below.

Figure 13:
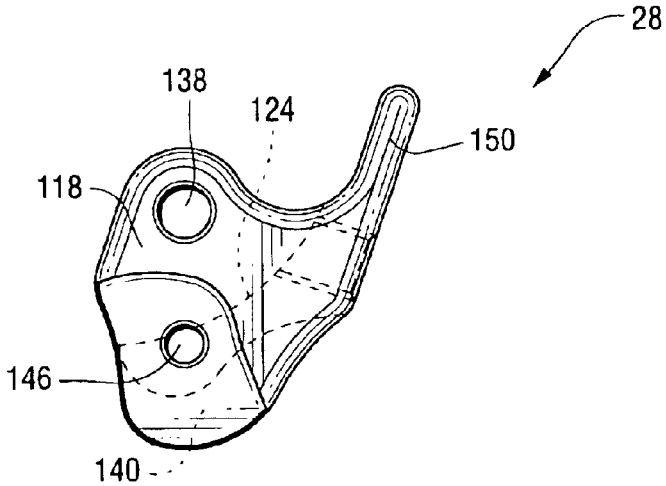
FIG. 13 is a side elevation of an intermediate link incorporated into the release shown in FIGS. 1-4.
Figure 14:
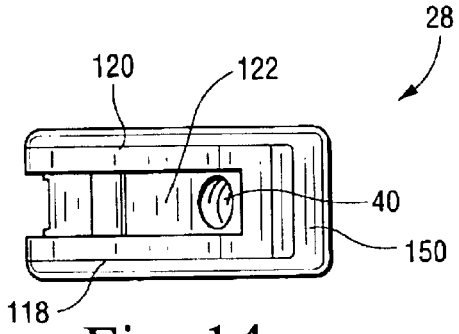
FIG. 14 is a top plan view of the intermediate link shown in FIG. 13.

As noted above, the intermediate link 28 of the release head assembly 26 is pivotally mounted on the remote end of the post 22, in a space between laterally spaced bosses 23, 24 via pin 32. The intermediate link 28 (also shown in FIGS. 13-15) includes a pair of flanges 118, 120 that establish an upper groove or recess 122 therebetween, the base 124 of the groove being curved as best seen in FIGS. 1, 4 and 13. The upper groove or recess 122 receives the D-shaped pawl 36, and the threaded bore 40 opens into the recess 122 and receives the set screw 38. Thus, pawl 36 may be adjusted rotationally about pin 34 and fixed in place via set screw 38 when it is in the desired position vis-a-vis the sear edge 46. In this regard, the pawl 36 includes a radiused surface 128 and a chordal, straight surface 130 that define edges 132, 134. A smooth bore hole 136 in the pawl is alignable with holes (one shown at 138 in FIG. 13) in the flanges 118, 120 for receiving pin 34 as described further below.

Figure 15:
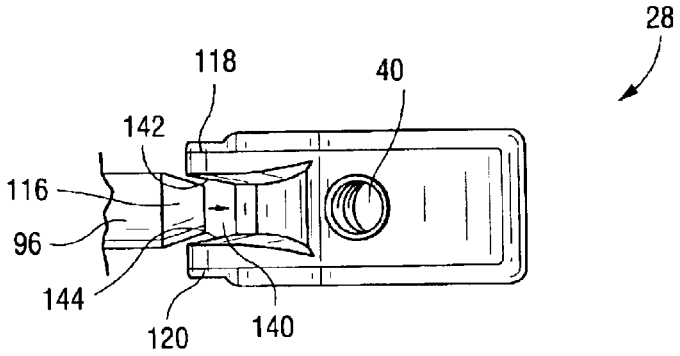
FIG. 15 is a partial assembly, illustrating the manner in which the locking rod engages the intermediate link.
Figure 16:
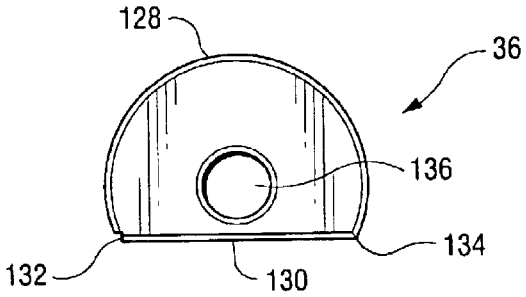
FIG. 16 is a side elevation of a pawl component incorporated into the assembly shown in FIGS. 1-4.
Figure 17:
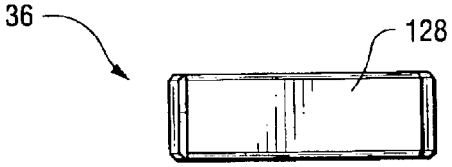
FIG. 17 is a top plan view of the pawl shown in FIG. 16.
Figure 18:
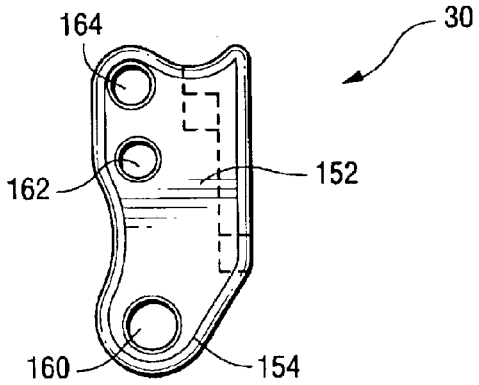
FIG. 18 is a side elevation of a forward link of the release head assembly incorporated into the assembly shown in FIGS. 1-4.

The flanges 118, 120 also define a lower recess 140 that is defined in part by opposed, tapered surfaces 142, 144 (FIG. 15) that are centered above the locking rod 96. With particular reference to FIG. 15, it can be seen that axial movement of rod 96 will cause the truncated, cone-shaped end 116 of the rod to engage or disengage surfaces 142, 144 depending on the direction of movement of the rod 96. More specifically, the truncated cone 116 of the locking rod 96 will engage the surfaces 142, 144 when the locking rod 96 is raised (as viewed in FIGS. 3 and 4), and conversely, will disengage when the locking rod is lowered. When engaged, the intermediate link 28 is fixed relative to the post 22 and handle portion 12 to prevent unwanted pivoting motion of the intermediate link 28 during final draw and shoot movements of the archer's hand and/or wrist.

The intermediate link 28 also includes aligned holes, one shown at 146, that align with holes in the post bosses 23, 24 for receiving the pin 32. Note that link 28 fits between the bosses 23, 24. Pin 32 is press fit within aligned holes in the bosses 23, 24, but permits rotation of link 28 about the pin. One end of the link 28 is provided with an upstanding tab 150 that projects generally toward the forward link 30, and that serves as a movement limiter for the forward link.

Figure 2:
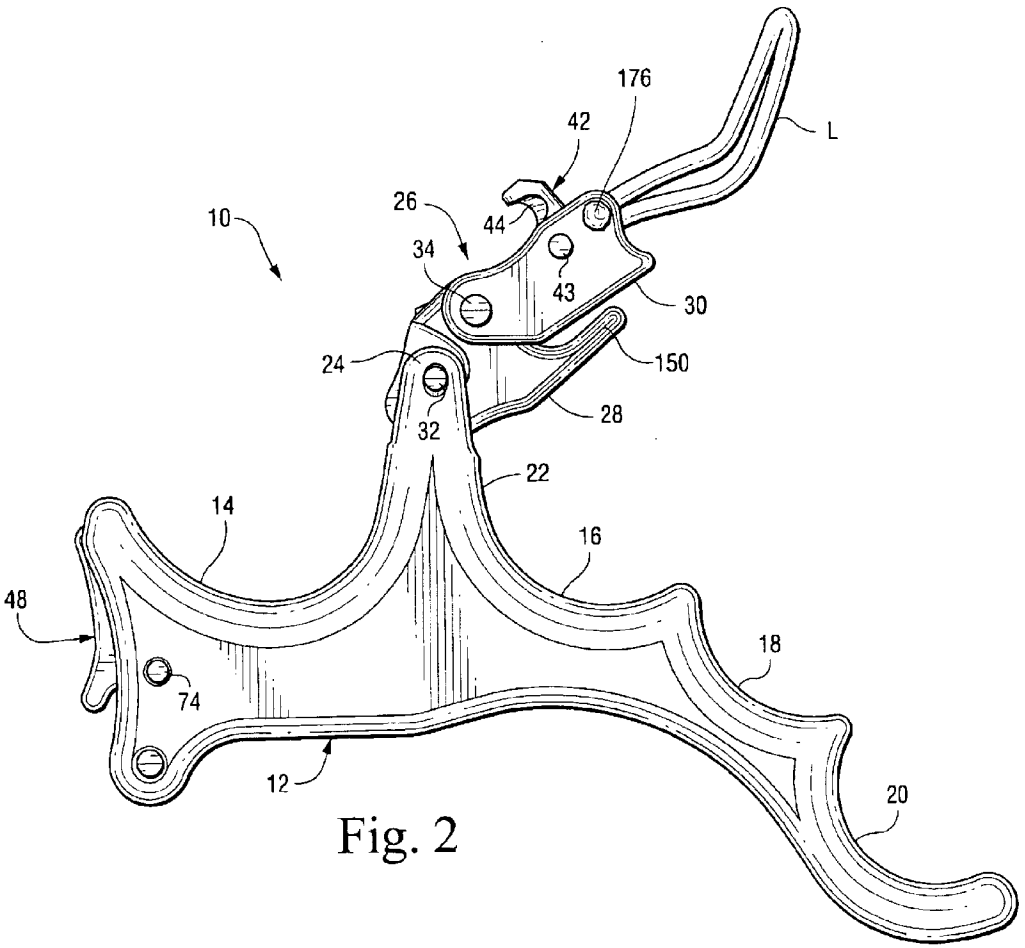
FIG. 2. is a side elevation of the release shown in FIG. 1.

The forward link 30 of the release head assembly includes a base portion 152 with laterally spaced sides 154, 156. At the end of the forward link 30 closest the intermediate link 28, aligned holes 158, 160 are provided in the respective sides 154, 156. These holes align with a second set of aligned holes in the intermediate link 28 (see hole 138 in FIG. 13), permitting press fit of pin 34 to pivotally secure the forward link to the intermediate link 28. Pin 34 is press fit into the holes 158, 160 but sufficient clearance is provided in the aligned holes in the intermediate link 28 and pawl 36 so that the forward link 30 and pin 34 rotate together relative to the intermediate link 28 and pawl 36. Adjacent the remote end of the forward link 30, aligned holes, one shown at 162, are provided for receiving in press fit relationship the pin 43 that also passes through the sear 42 to pivotally secure the latter to the forward link 30. Closely adjacent the holes 162 are another pair of holes, one shown at 164, that retain free ends of the loop L. The latter may be inserted through the holes and then melted (or heat riveted) to secure the loop ends to the forward link 30 as best seen in FIGS. 1, 2 and 23.

Figure 21:
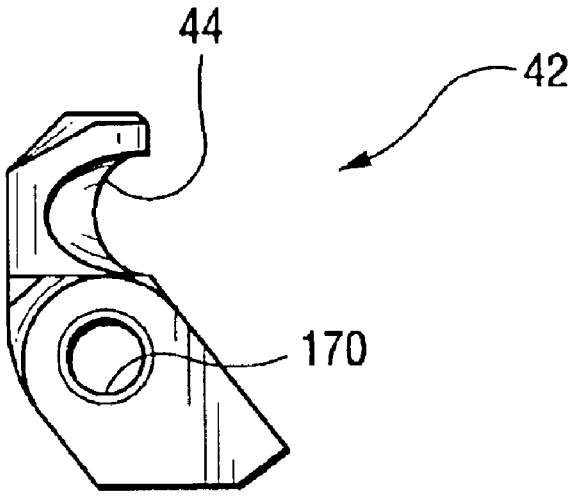
FIG. 21 is a side elevation of a sear component incorporated into the release shown in FIGS. 1-4.
Figure 22:
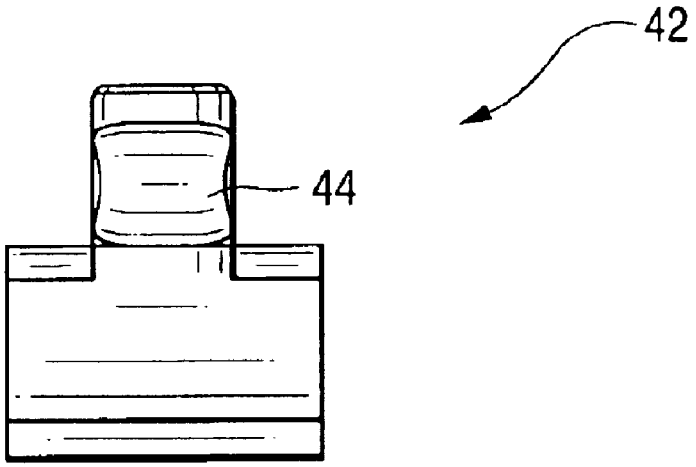
FIG. 22 is a top plan view of the sear illustrated in FIG. 21.

Sear 42 is best seen in FIGS. 21 and 22 and is formed with a hole 170 that aligns with holes 162 so that pin 43 can be press fit into the forward link 30 to secure the sear to the forward link, but free to pivot about the pin 43.

Given the above construction, it is apparent that the sear 42 is pivotable relative to the forward link 30, but with limits imposed by the pawl 36 and surface 166 of the forward link 30. The forward link 30 is also pivotable relative to the intermediate link 28 via pin 34, within limits set by tab 150 and pawl 36. The intermediate link 28 is pivotable via pin 32 relative to the post 22 within limits set by the fork formed by post bosses 23, 24. The operation of the release 10 will now be described.

With reference to FIG. 3, when the end 86 of lever 48 is depressed, the lever 48 will pivot about pin 84 in a clockwise direction (as viewed in FIG. 3), pushing the toggle link 70 to the right, with the cradle 68 acting on the ball 56 of the drive rod 54, causing the latter to move to the right as well. As the drive rod cam surface 64 rides over the cam surface 106 on the locking rod 96, the latter will be pulled downwardly, against the bias of spring 112, and thus causing the forward truncated cone-shaped end 116 of the locking rod 96 to disengage from the surfaces 142, 144 on the intermediate link 28, thus freeing the latter for pivoting movement about the pin 32.

As the lever 48 reaches the limit of its travel, pivot pin 76 that mounts the toggle link 70 to the lever, swings just beyond the longitudinal axis of the drive rod 54, against the bias of spring 92. The shape of the cradle 68 enables the drive connection with the ball 56 to be maintained as the rearward end of the toggle moves to its "over-the-center" position, thereby maintaining the drive rod 54 in its extended position, holding the locking rod 96 in an unlocked or retracted position.

When the opposite end 88 of the lever 48 is depressed, the toggle link 70 swings back to a substantially centered position, allowing spring 92 to push the drive rod 54 rearwardly (to the left in FIGS. 3 and 4) such that cam surfaces 64 and 106 disengage sufficiently to allow spring 90 to push the locking rod 96 and its tapered end 116 forward into engagement with the surfaces 142, 144 on the intermediate link 28, thereby locking the intermediate link 28 relative to the post 22.

To use the release, end 86 of the lever 48 is initially depressed to free up the intermediate link 28 as described above, such that both the intermediate and forward links 28, 30 of the release head assembly 26 are free to pivot or swivel throughout their respective ranges of movement, relative to the post 22 (and hence handle portion 12) and relative to each other. With the sear edge 46 located behind the pawl edge 134, i.e., edge 46 is to the right of edge 134 as viewed in FIG. 3. The rope L is then looped about the bow string (see FIG. 23) and slipped over the hook portion 44 of the sear 42. The sear 42, pivotally supported on the forward link 30, can be properly located with edge 46 behind the pawl edge 134 due to the ability of the forward link to rotate relative to the intermediate link 28, and of course, the ability of the sear 42 to rotate relative to the forward link 30. In this position, the sear is prevented from moving past the pawl, absent movement of the pawl relative to the sear.

As the archer draws the release toward his chest and face, any lateral movement of the hand and subsequent rotation of the handle portion 12 will not translate to the intermediate link 28 or to the pawl 36 which is fixed thereto, because of the freedom of the release handle portion 12 to rotate relative to the release head assembly 26, and of the intermediate and forward links 28, 30 to rotate relative to each other.

When the full draw position is reached, or just prior, and with the optimum draw position having been achieved, the archer will depress the end 88 of lever 48, actuating the locking rod as explained above, to lock the intermediate link 28 in the desired position. Now, the intermediate link 28 and pawl 36 are fixed relative to the release post 22 and handle portion 12, but the forward link 30 (and sear 42) is still free to rotate about pin 34, but limited by the position of tab 150. The archer can now fire the arrow by a slight rotation of the handle and intermediate link 28, causing the pawl edge 134 to rotate past the sear edge 46 in a counterclockwise direction as viewed in FIGS. 3 and 4, thus releasing the sear 42 and hook 44 for rotation in a clockwise position that, in turn, releases the rope loop L and the bow string S under the influence of tension in the bow string.

It should be noted that while the intermediate link is "locked," D the archer may override the lock when under load, in a non-firing direction only, by rotating the handle in a counterclockwise direction so that the reactive force exerted by the outer link 30 on the tab 326 will cause the forward link 30 and intermediate link 28 to rotate in a clockwise or non-firing direction, thus permitting the archer to stand down without accidentally releasing the arrow.

With specific reference to FIG. 23, it is significant that as the bow string is being drawn to a fully tensioned position, the adjacent and doubled back strands 172, 174 of the loop L, are maintained in a closely and substantially parallel relationship. In fact, the distance between the strands 172, 174 remains substantially equal, or even increases slightly in the direction of the bow string. This arrangement is achieved by locating hook 44 adjacent pin 43 and rope loop ends 176 adjacent and forward of pin 43. This relationship insures that the bow string remains substantially fixed in the cradle or loop of the rope L throughout the draw, insuring consistent release points and accuracy of the shots.

Referring now to FIGS. 24-30, an alternative configuration for the pawl and intermediate link is illustrated that permits enhanced adjustment of the pawl relative to the sear. Specifically, with particular reference to FIGS. 24-26, a modified pawl 280 is formed to have a substantially triangular shape with two equal length sides 282, 284 and a base 286. Sides 282 and 284 intersect the base at a pair of radiused, truncated corner areas 288, 290. Edges of both sides and the base 20 are beveled as indicated at 292. A central mounting bore or hole 294 permits the pawl to be pivotally secured to the intermediate link 296 as described below.

Figure 28:
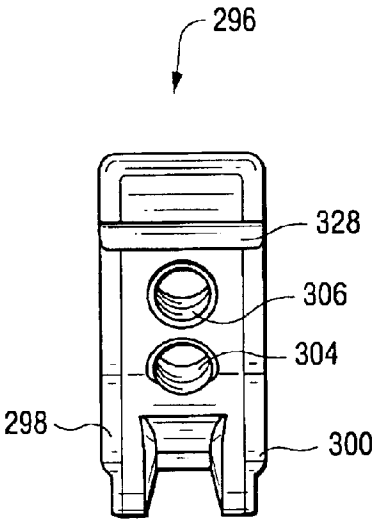
FIG. 28 is a right side view of the intermediate link shown in FIG. 27.
Figure 27:
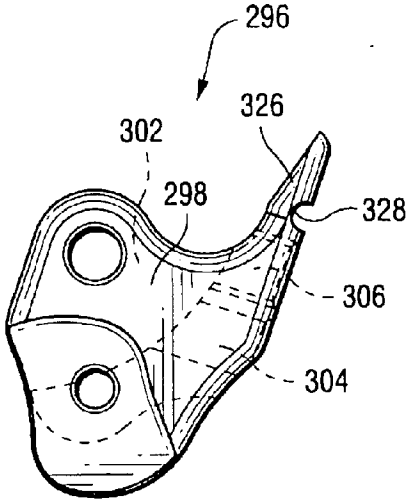
FIG. 27 is a side elevation of a modified intermediate link in accordance with the second embodiment of the invention.
Figure 29:
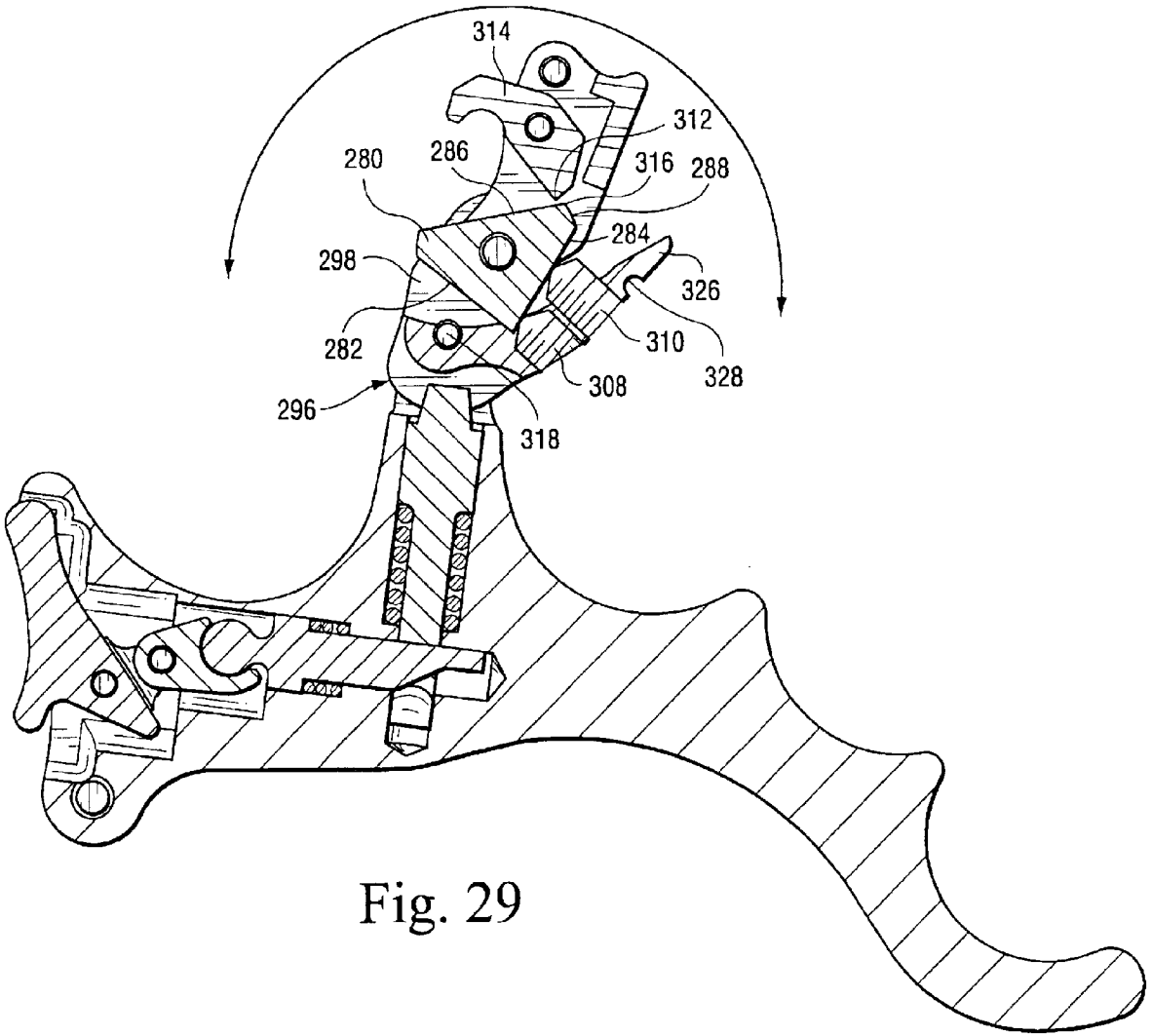
FIG. 29 is a partially cut away view of the pawl and intermediate link components shown in FIGS. 24-28 and the forward link shown in FIG. 30, assembled in a release otherwise similar to the release in FIGS. 1-3.

The intermediate link 296 shown in FIGS. 27, 28 is similar to the link 28 in that it includes a pair of flanges 298, 300 that define an upper groove or recess 302 that receives the pawl 280 in the manner shown in FIG. 29. The bore 40 in link 28 is now replaced by a pair of threaded bores 304, 306 for receiving set screws 308, 310, respectively.

With the components arranged as shown in FIG. 29, it may be seen that the sear edge 312 of the sear 314 interacts with pawl edge 316 where base 286 is joined to truncated corner area 288 of the pawl 280, substantially as previously described. The adjustability of the pawl relative to the sear is enhanced by the utilization of the set screws 308, 310. Note that screws 308 and 310 are located so as to engage side 284 of the pawl, but on different sides of the pin 318 by which the pawl 280 is secured to the intermediate line 296. Thus, tightening movement of one screw 310 causes rotation of the pawl 280 about pin 318 in one direction, while tightening of the other screw 308 causes rotation of the pawl 280 in the opposite direction. This arrangement permits very fine adjustment of the pawl truncated corner area 288 relative to the edge 312 of the rear 314. In this regard, it is necessary to loosen screw 308 in order to move the pawl in a counterclockwise direction, and then to tighten screw 310 to lock the pawl in place. Adjustment in the clockwise direction requires an opposite adjustment of the screws.

Figure 19:
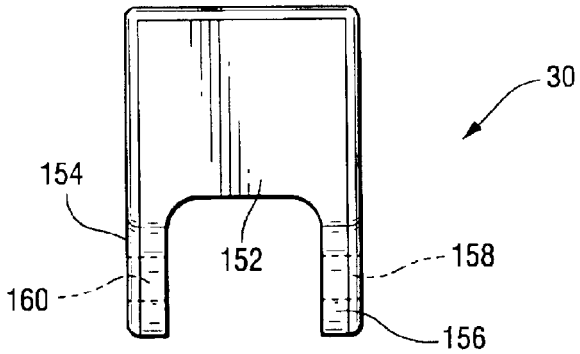
FIG. 19 is an end elevation of the forward link shown in FIG. 18.
Figure 20:
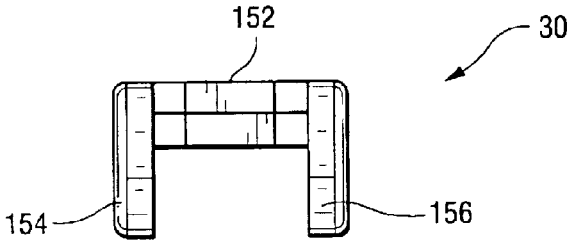
FIG. 20 is a front elevation view of the forward link shown in FIG. 19.
Figure 30:
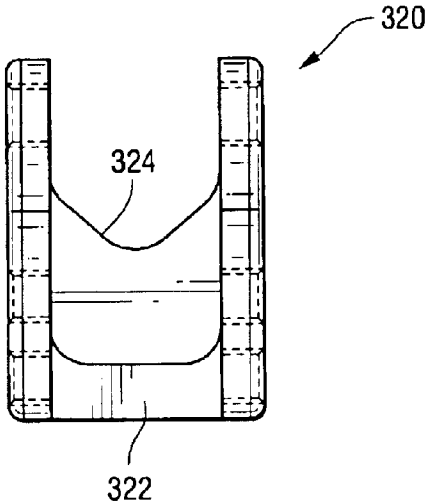
FIG. 30 is an end elevation of a forward link in accordance with the second embodiment of the invention.

The sear cage or forward link 320 shown in FIG. 30 is similar to forward link 30, except that the base 322 has been modified to provide additional space to accommodate the triangular pawl by removal of material to form a shallow V-shaped opening 324 rather than the squared-off opening evident in FIG. 19. This increased opening, in turn, requires an extension of the tab 150 on the intermediate link, the extended tab 326 shown most clearly in FIGS. 27 and 29. The tab 326, like tab 150, sets the limit of motion in one direction of the forward link 320 relative to the intermediate link 296.

Figure 31:
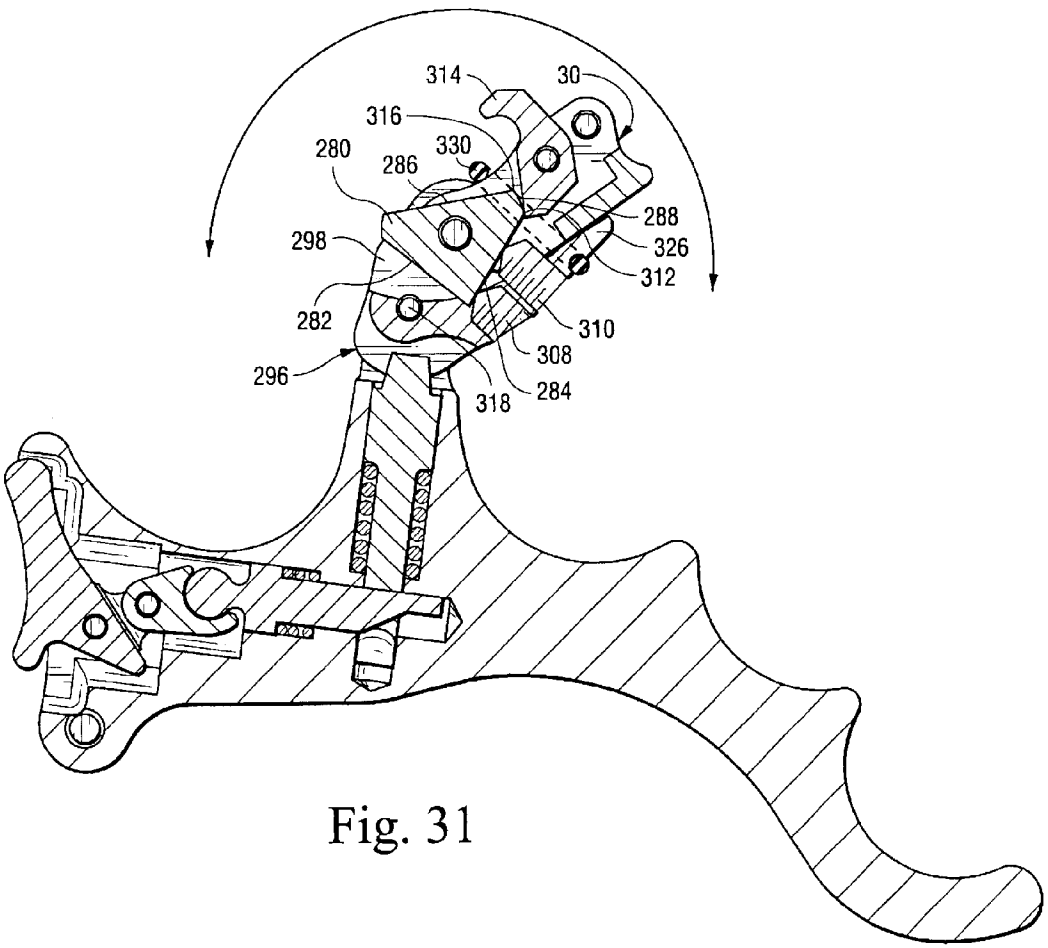
FIG. 31 is a partially cut away view similar to FIG. 29 but with the forward link, sear and hook resiliently held in a cocked position by a rubber O-ring.
Figure 32:
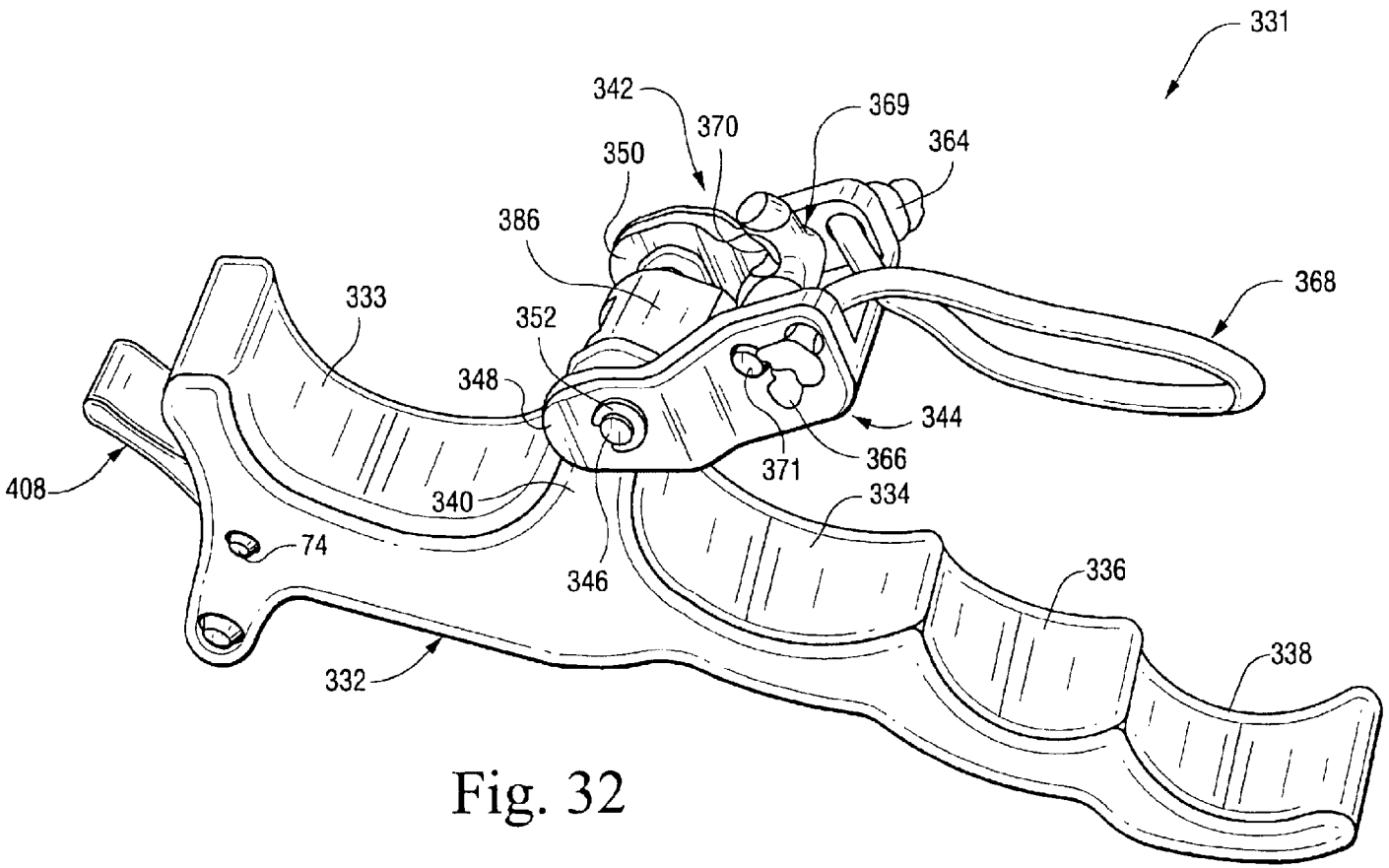
FIG. 32 is a perspective view of a release in accordance with a third and presently preferred embodiment of the invention.
Figure 33:
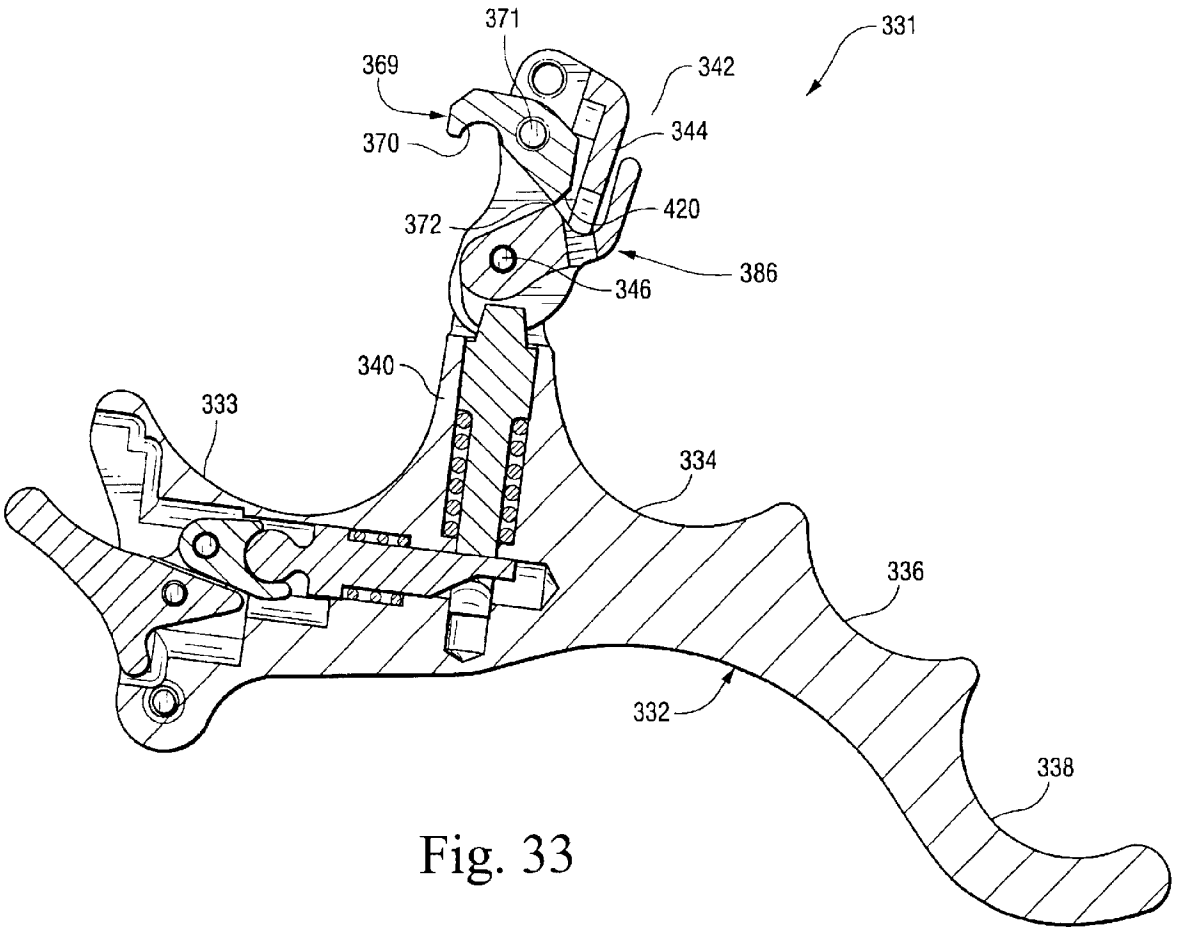
FIG. 33 is a side cross-section of the release shown in FIG. 32.

A transverse groove 328 (best seen in FIGS. 29 and 31) in the tab 326 is provided for a rubber O-ring 330 that may be used to resiliently hold the forward link 30, sear 42 and hook 44 in an engaged or cocked position (see FIG. 30), providing for ease of loading.

FIGS. 32-41 relate to a presently preferred embodiment of the invention. With initial reference to FIGS. 32 and 33, the release 331 includes a handle portion 332 formed with four finger grooves 333, 334, 336 and 338. Here again, the number of grooves may be varied as desired. Between grooves 333 and 334, the groove separating part 340 of the handle portion is thickened and lengthened somewhat to pivotally mount the release head assembly 342 as described further below, and to accommodate internally a locking mechanism similar to that previously described.

Figure 34:
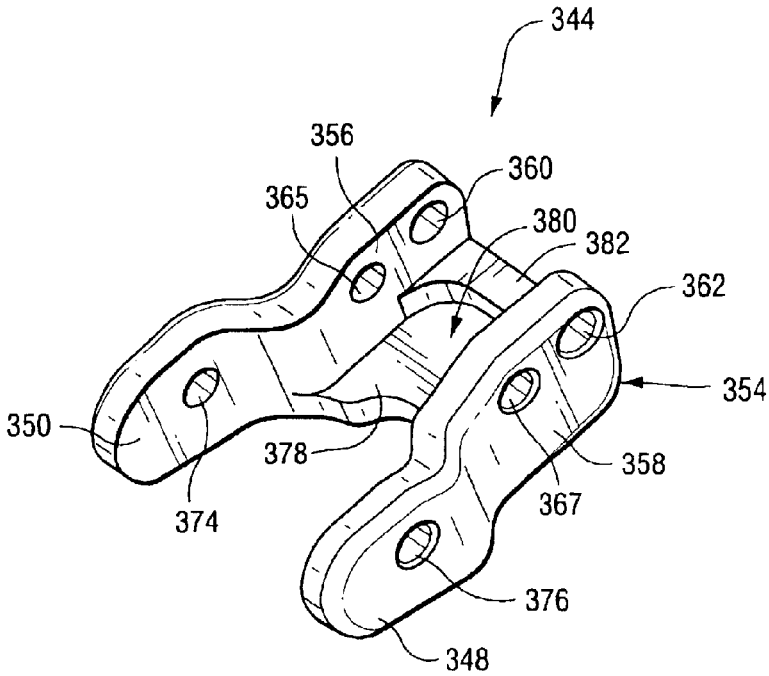
FIG. 34 is a perspective view of a single link or yoke component taken from the assembly in FIGS. 32 and 33.
Figure 35:
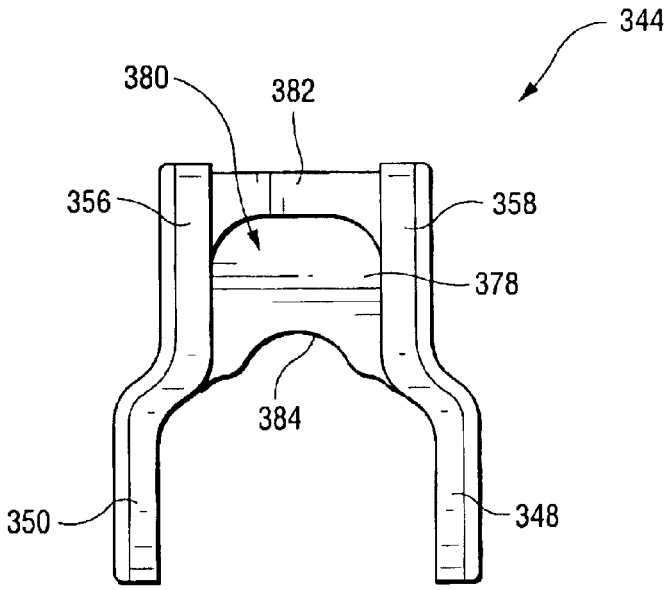
FIG. 35 is a front elevation of the yoke shown in FIG. 34.
Figure 36:
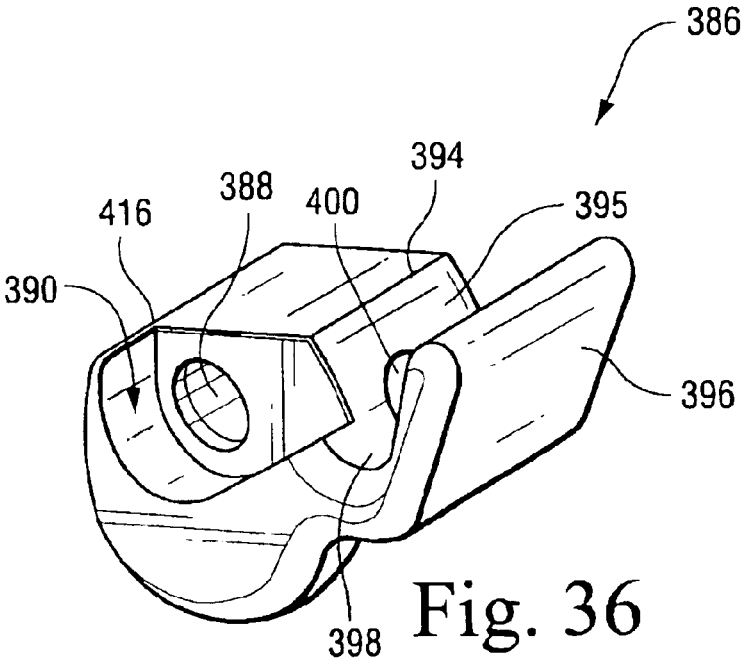
FIG. 36 is a perspective view of a pawl head component taken from the assembly in FIGS. 32 and 33.
Figure 37:
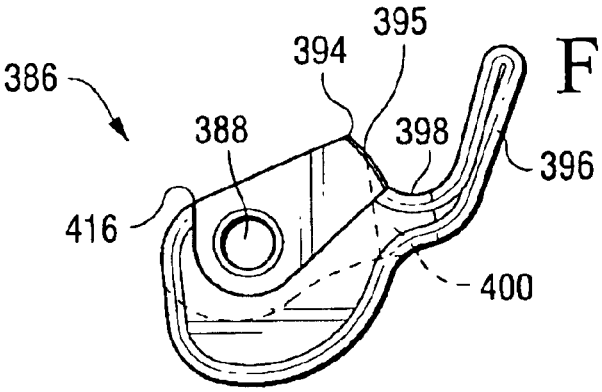
FIG. 37 is a side elevation of the pawl head component shown in FIG. 36.
Figure 38:
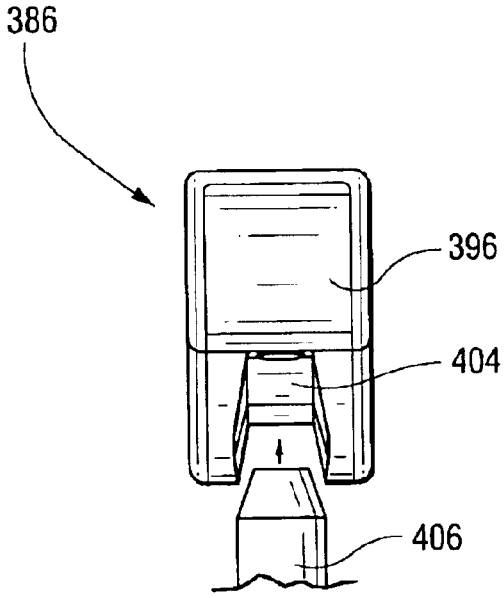
FIG. 38 is a front elevation of the pawl head component shown in FIG. 36.
Figure 39:
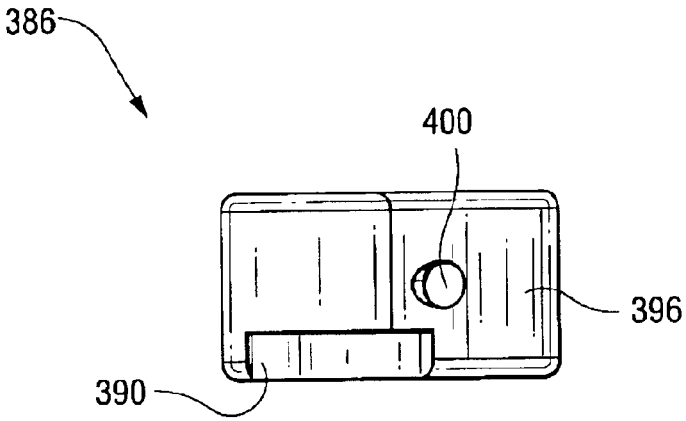
FIG. 39 is a top plan view of the pawl head component shown in FIG. 36.

The release head assembly 342 in this embodiment has been simplified to essentially eliminate the intermediate link of the earlier described embodiments. Here, a single link or yoke 344 (or sear cage) is pivotally mounted to the handle portion (more specifically to the groove separating part 340) via a pin 346 that passes through the part 340 and ears 348, 350 of the yoke 344, and is secured by conventional C-clips (one shown at 352) or other suitable means. The yoke itself is best seen in FIGS. 34 and 35 and includes a substantially U-shaped yoke body 354, with ears 348, 350 formed as extensions of the sides or legs 356, 358 of the U-shaped body. The yoke sides or legs 356, 358 are formed with a first pair of aligned holes 360, 362 which receive respective ends 364, 366 (FIG. 32) of the rope loop 368 in the same manner as previously described. The yoke sides 356, 358 are also formed with a second pair of aligned holes 365, 367 used to pivotally mount the sear 369 via pin 371. The sear 369 (FIGS. 32, 33) is substantially identical to the sear 42 (FIGS. 21 and 22) and includes a rope loop hook 370 and a sear edge 372.

The ears 348, 350 of the yoke are formed with a third pair of aligned holes 374, 376 that receive the previously described pin 346 for mounting the yoke to the handle part 340. The yoke body 354 includes a web 378 extending between the legs 356, 358. A recessed area 380 is partially defined at one end of the web 378 by an integral arch-shaped upper portion 382 that is substantially flush with the end surfaces of sides 356, 358. The recessed area 380 facilitates movement of the sear 369 about its pivot pin 371. The other end of the web 378 is formed with an arch-shaped opening 384 intermediate the legs 356, 358 serving to accommodate the movement of the pawl head 386 described further below.

In this preferred embodiment, the pawl and intermediate link of the earlier described embodiment (items 36 and 28, respectively) have been combined into a single pawl head 386 (best seen in FIGS. 36-39) that is pivotally secured to the handle portion 332 by the pin 346 also used to secure the yoke 344 to the handle portion. In this regard, the pawl head 386 lies inside the ears 348, 350 when assembled (see FIG. 32). The pawl head 386 is formed with a transverse through-hole 388 for receiving the pin 346. Note the recessed portion or offset 390 on one side of the pawl head, adjacent one end of the hole 388. This recessed area provides space for a spring 392 (FIG. 40) as described further below. The pawl head 386 is shaped to include a laterally extending pawl edge 394 and an adjacent radiused surface 395 that are adapted to cooperate with sear edge 372 to release the sear and thus the rope loop as described below. The pawl head 386 is further configured to include an upstanding tab 396 that is similar to tab 150 in the earlier described embodiment, the tab 396 laterally spaced from the pawl edge 394 by a curved portion 398. A threaded hole 400 extends through this curved portion and receives a set screw 402 (FIG. 41). This allows adjustment of the firing sensitivity as also further described below.

The pawl head 396 is also provided with a groove 404 on the underside thereof (i.e., on the side opposite the pawl edge 394) that is adapted to receive the locking rod 406 (see FIG. 38) that locks the pawl head in place via actuation of lever 408 in the handle portion 332 in the same manner as described in connection with the embodiments illustrated in FIGS. 1-29.

Figure 40:
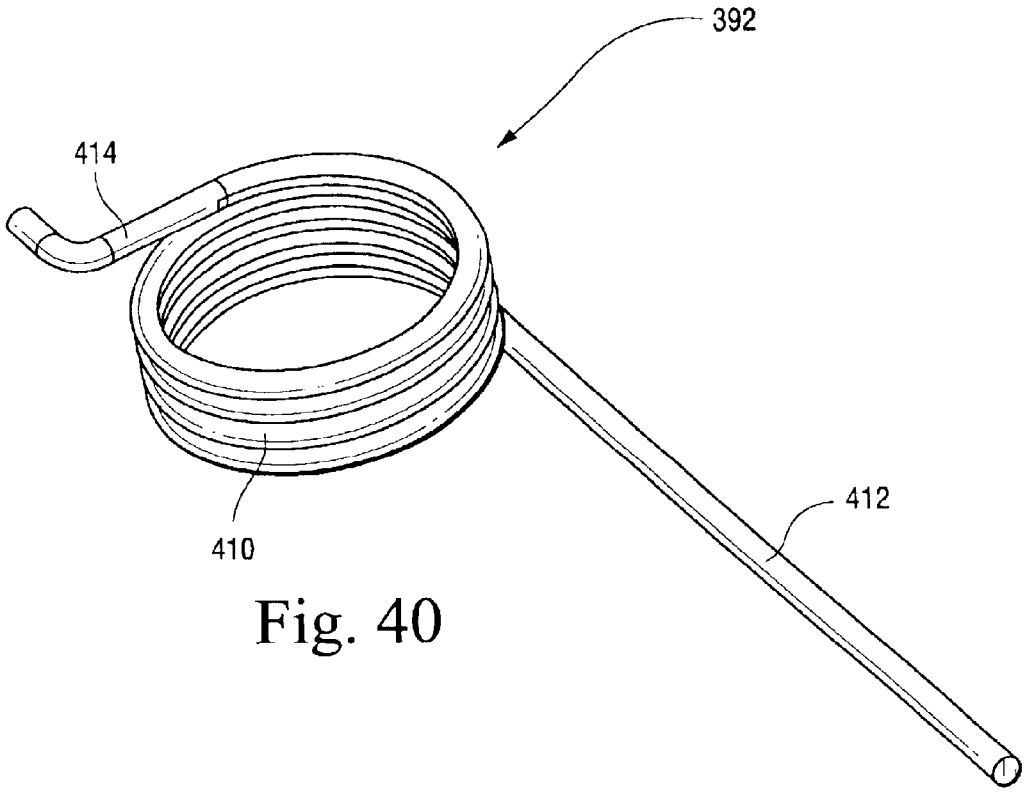
FIG. 40 is a perspective view of a spring used in the assembly shown in FIGS. 32 and 33.
Figure 41:
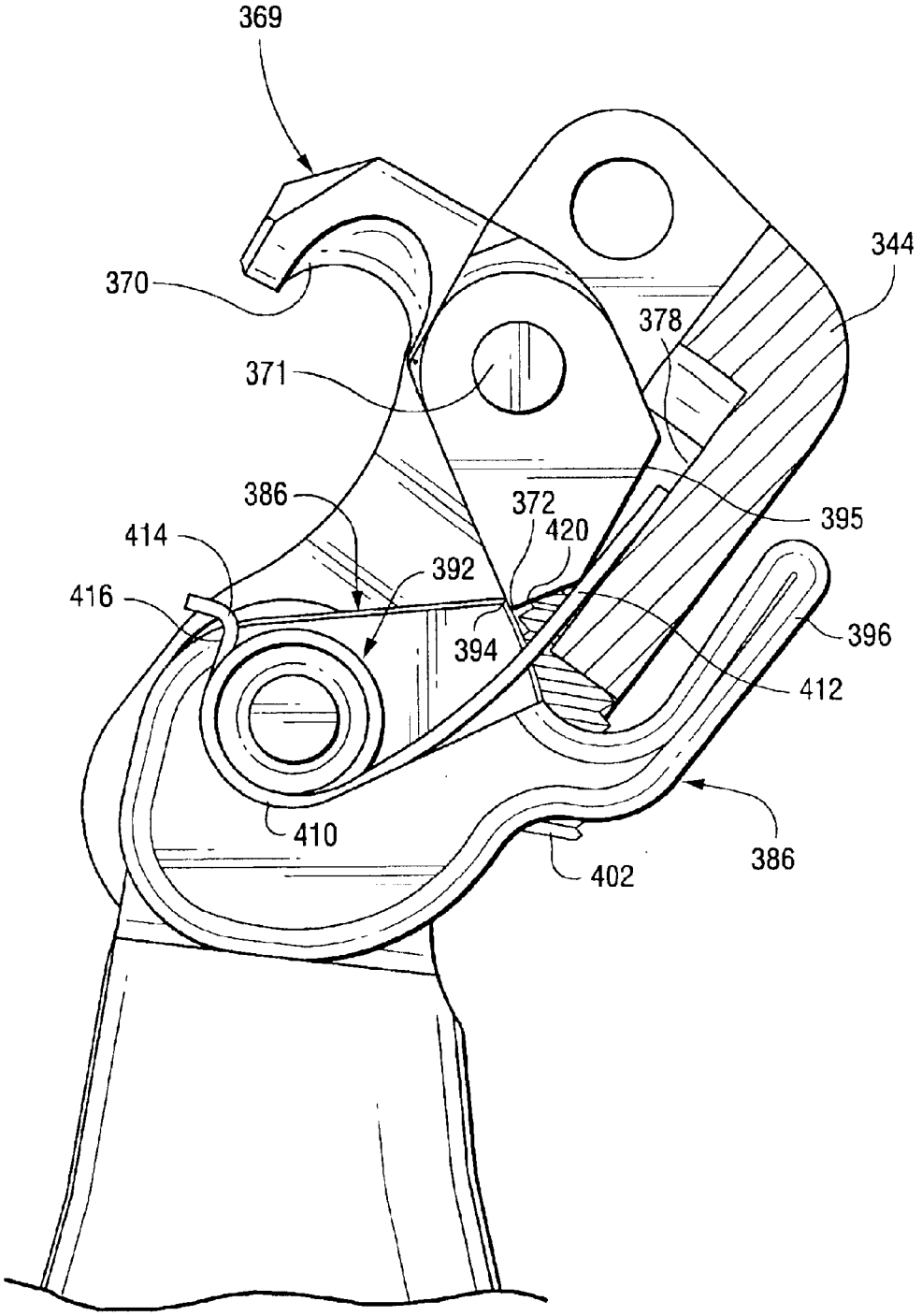
FIG. 41 is a partial side elevation, partly in section, illustrating the placement of the spring in FIG. 40 within the release shown in FIG. 32.

With reference to FIG. 40, the spring 392 has an annular coil portion 410, an extended straight stem 412 at one end of the coil portion, and a shorter, L-shaped stem 414 at the opposite end of the coil portion. With further reference to FIG. 41, the coil portion 410 is slipped over the pin 346 and is located in the recessed area 390 of the pawl head 386. The shorter L-shaped stem 414 bears on edge 416 of the pawl head, adjacent recess 390, while the extended straight stem 412 bears on surface 378 of the yoke 344. This arrangement biases the yoke 344 and pawl head 386 to the position shown in FIG. 41, but it will be appreciated that these components (344 and 396) can move relative to one another, against the spring bias. FIG. 41 also illustrates the manner in which the set screw 402, threaded into hole 400, acts on surface 420 of the sear 369 to adjust the position of the sear edge 372 on radiused surface 395, relative to the pawl edge 394, thereby adjusting the sensitivity of the release.

In use, as the archer draws the release 331 toward his chest and face, any rotation of the handle portion 332 will have no relative effect on the yoke 344 or pawl head 386 as explained in connection with the earlier described embodiments. When the full draw position is searched, or just prior, the handle lever 408 is depressed to lock the pawl head 386 in place, while the yoke 344 (and sear 369) remain free to float, but limited by the position of tab 396. The archer can now fire the arrow by an additional slight rotation of the handle portion 332 and pawl head 386, until the pawl edge 394 rotates past the sear edge 372, thus releasing the sear 369 and hook 370 for rotation in a clockwise direction (as viewed in FIG. 41) which, in turn, releases the rope loop and bow string to fire the arrow.

Spring 392 will return the yoke 344 to its pre-release position, but the sear edge 372 must be relocated manually behind the pawl edge 394 before re-loading.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A triggerless back tension release for use with a bow string comprising:

a handle;

a release head assembly including a rope loop and a first component pivotally mounted relative to a portion of said handle, said first component carrying a sear element having a sear edge and a hook adapted for receiving said rope loop;

a locking rod located in said handle portion and actuated by a lever in said handle portion to enrage and lock a second component of the release head assembly relative to said handle, said second component arranged to interact with said sear edge and to release said sear element and thereby release the bow string upon movement of the handle.

2. The triggerless back tension release of claim 1 wherein said release head assembly is a two-link release head assembly secured to a free end of said portion of said handle, said second component comprising an intermediate link pivotably mounted on said portion of said handle and said first component comprising a forward link pivotably mounted to said intermediate link.

3. The release of claim 2 and further comprising a lever in said handle and a locking rod slidably received in said portion of said handle and selectively engageable with said intermediate link, said lever operatively connected to said locking rod to move said locking rod toward or away from said intermediate link.

4. The release of claim 3 wherein a drive rod is slidably received in said portion of said handle and connected to said lever by a toggle link pivotally connected to said lever; a forward end of said drive rod and a rearward end of said locking rod having cooperating cam surfaces such that movement of said drive rod toward said locking rod causes said locking rod to move away from said intermediate link.

5. The release of claim 4 wherein said drive rod is formed with a substantially ball-shaped rearward end that is nested within a cradle portion of said toggle link.

6. The release of claim 5 wherein a pivot axis of said toggle link is moveable from a position substantially aligned with a longitudinal axis of the drive rod to a position offset from said longitudinal axis as said drive rod moves toward said locking rod.

7. The release of claim 3 wherein said locking rod is engaged by a first spring arranged to bias said locking rod toward said intermediate link.

8. The release of claim 7 wherein said drive rod is engaged by a second spring arranged to bias said drive rod away from said locking rod.

9. The release of claim 8 wherein said lever includes press surfaces at opposite ends thereof such that pressing one end of said lever causes said drive rod to move toward said locking rod and to move said locking rod away from said intermediate link, and pressing the other end of said lever causes said drive rod to move away from said locking rod and permitting said first spring to move said locking rod into engagement with said intermediate link.

10. The release of claim 3 wherein said intermediate link is free to rotate about a first pivot pin in said portion of said handle and wherein said locking rod has a tapered end movable into engagement with said intermediate link upon movement of said lever to lock said intermediate link relative to said handle in any position within a range of movement of said intermediate link.

11. The release of claim 10 wherein said forward link is rotatable about a second pivot pin fixed to said intermediate link whether said intermediate link is locked or unlocked.

12. The release of claim 11 wherein said intermediate link includes a tab positioned to limit pivoting movement of said forward link when said intermediate link is locked.

13. The release of claim 2 including an O-ring for resiliently holding said intermediate link and said forward link in engagement with one another.

14. The release of claim 1 wherein said first component comprises a yoke having a pair of laterally spaced sides and ears depending from said sides, and a first pin extending through said ears and said portion of said handle to thereby pivotally mount said first component to said portion of said handle; said sear element located between said laterally spaced sides and pivotally mounted to said yoke by a second pin extending through said sides and said sear element.

15. The release of claim 14 wherein said second component comprises a pawl head located between said laterally spaced ears and carried by said first pin, said pawl head having a pawl edge arranged to interact with said sear edge.

16. The release of claim 15 and further comprising a set screw extending through said pawl head and adapted to engage a surface of said sear element to adjust relative positions of said sear edge and said pawl edge.

17. A triggerless back tension release for use with a bow string comprising:

a handle;

a release head assembly including a rope loop and a first component pivotally mounted relative to a portion of said handle, said first component comprising a yoke having a pair of laterally spaced sides and cars depending from said sides, and a first pin extending through said ears and said portion of said handle to thereby pivotally mount said yoke to said portion of said handle;

a sear element located between said laterally spaced sides and pivotally mounted to said yoke by a second pin extending through said sides and said sear element, said sear element having a sear edge and a hook adapted for receiving said rope loop;

a pawl head located between said laterally spaced ears and carried by said first pin, said pawl head having a pawl edge arranged to interact with said sear edge and thereby free said sear element for rotation permitting said rope loop to escape said rope hook; and a locking rod located in said handle and actuated by a lever in said handle, said locking rod adapted to engage and lock said pawl head relative to said handle.

18. The release of claim 17 and further comprising a spring mounted on said first pin, said spring having a coil portion and a pair of stems, said pair of stems engaging respective surfaces on said pawl head and said yoke.

19. The release of claim 17 wherein said rope loop is secured at opposite ends thereof to said laterally spaced sides of said yoke.

20. The release of claim 17 wherein said pawl head is formed with a groove arranged to receive said locking rod.

21. The release of claim 17 wherein said pawl head is provided with a tab arranged to engage said yoke and thereby limit movement of said pawl head relative to said yoke.

22. The release of claim 17 and further comprising a set screw extending through said pawl head and adapted to engage a surface of said sear element to adjust relative positions of said sear edge and said pawl edge.

23. A bow string release comprising:

a handle;

a release head assembly including a rope loop and a first component pivotally mounted to said handle, said first component comprising a yoke having a pair of sides and ears and a mounting pin extending through said ears;

a sear element pivotally mounted to said yoke between said sides;

a pawl head between said ears and carried by said mounting pin, and having a pawl edge adapted to interact with said sear element; and a locking rod in said handle to lock said pawl head relative to said handle.

* * * * *